US009004149B2

(12) United States Patent
Waniuk et al.

(10) Patent No.: US 9,004,149 B2
(45) Date of Patent: Apr. 14, 2015

(54) COUNTER-GRAVITY CASTING OF HOLLOW SHAPES

(71) Applicants: Apple Inc., Cupertino, CA (US); Crucible Intellectual Property, LLC, Rancho Santa Margarita, CA (US)

(72) Inventors: Theodore A. Waniuk, Lake Forest, CA (US); Joseph Stevick, North Tustin, CA (US); Sean O'Keeffe, Tustin, CA (US); Dermot Stratton, San Francisco, CA (US); Joseph Poole, San Francisco, CA (US); Matthew Scott, Campbell, CA (US); Christopher Prest, San Francisco, CA (US)

( * ) Notice: Subject to any disclaimer, the term of this patent is extended or adjusted under 35 U.S.C. 154(b) by 0 days.

(21) Appl. No.: 14/198,993

(22) Filed: Mar. 6, 2014

(65) Prior Publication Data

US 2014/0182804 A1 Jul. 3, 2014

Related U.S. Application Data

(62) Division of application No. 13/628,593, filed on Sep. 27, 2012, now Pat. No. 8,701,742.

(51) Int. Cl.

| | |
|---|---|
| ***B22D 27/13*** | (2006.01) |
| ***B22D 17/00*** | (2006.01) |
| ***B22D 18/00*** | (2006.01) |

(Continued)

(52) U.S. Cl.

CPC ..... *B22D 18/00* (2013.01); *B22D 17/00* (2013.01); *B22D 17/14* (2013.01); *B22D 27/13* (2013.01); *B22D 27/20* (2013.01); *B22D 25/02* (2013.01)

(58) Field of Classification Search

CPC ..... B22D 13/00; B22D 13/04; B22D 13/06; B22D 13/10; B22D 13/107; B22D 17/00; B22D 17/14; B22D 18/00; B22D 25/02; B22D 27/13

USPC ..... 164/113–120, 286–301, 303, 306

See application file for complete search history.

(56) References Cited

U.S. PATENT DOCUMENTS

| | | | |
|---|---|---|---|
| 2,195,360 | A | 3/1940 | Daesen |
| 2,657,429 | A | 11/1953 | Faust |

(Continued)

FOREIGN PATENT DOCUMENTS

| | | |
|---|---|---|
| DE | 19902002 | 7/2000 |
| EP | 0569511 | 11/1993 |

(Continued)

OTHER PUBLICATIONS

Inoue et al., "Bulk amorphous alloys with high mechanical strength and good soft magnetic properties in Fe—Tm—B(TM=IV-VIII group transition metal) system", Appl. Phys. Lett., vol. 710, p. 464 (1997).

(Continued)

*Primary Examiner* — Kevin E Yoon

(74) *Attorney, Agent, or Firm* — Brownstein Hyatt Farber Schreck, LLP

(57) ABSTRACT

The embodiments described herein relate to methods and apparatus for counter-gravity formation of BMG-containing hollow parts. In one embodiment, the BMG-containing hollow parts may be formed by first feeding a molten metal alloy in a counter-gravity direction into a mold cavity to deposit the molten metal alloy on a surface of the mold cavity and then solidifying the deposited molten metal alloy.

18 Claims, 8 Drawing Sheets

(51) Int. Cl.

| | |
|---|---|
| ***B22D 17/14*** | (2006.01) |
| ***B22D 27/20*** | (2006.01) |
| ***B22D 25/02*** | (2006.01) |

(56) References Cited

U.S. PATENT DOCUMENTS

| | | | | |
|---|---|---|---|---|
| 3,671,029 | A | 6/1972 | Karlsson et al. | |
| 3,731,727 | A | 5/1973 | Mitamura et al. | |
| 4,040,845 | A | 8/1977 | Richerson et al. | |
| 4,086,953 | A | 5/1978 | Kraklau | |
| 4,135,568 | A | 1/1979 | Brooks | |
| 4,265,294 | A | 5/1981 | Gaule et al. | |
| 4,347,889 | A | 9/1982 | Komatsu et al. | |
| 4,523,622 | A | 6/1985 | Faste et al. | |
| 4,550,412 | A | 10/1985 | Holcombe et al. | |
| 4,612,973 | A | 9/1986 | Whang | |
| 4,678,024 | A | 7/1987 | Hull et al. | |
| 4,693,299 | A | 9/1987 | Kuznetsov et al. | |
| 4,694,889 | A | 9/1987 | Spenceley et al. | |
| 4,799,532 | A | 1/1989 | Mizuhara | |
| 4,887,798 | A | 12/1989 | Julius | |
| 5,003,551 | A | 3/1991 | Mortimer | |
| 5,042,561 | A * | 8/1991 | Chandley | 164/63 |
| 5,087,804 | A | 2/1992 | McGaffigan | |
| 5,181,549 | A | 1/1993 | Shapovalov | |
| 5,230,379 | A * | 7/1993 | Voss | 164/63 |
| 5,288,344 | A | 2/1994 | Peker et al. | |
| 5,368,659 | A | 11/1994 | Peker et al. | |
| 5,487,421 | A | 1/1996 | Gerber | |
| 5,492,165 | A * | 2/1996 | Erana | 164/255 |
| 5,616,024 | A | 4/1997 | Nobori et al. | |
| 5,618,359 | A | 4/1997 | Lin et al. | |
| 5,620,043 | A * | 4/1997 | Chamarro et al. | 164/119 |
| 5,711,363 | A | 1/1998 | Scruggs et al. | |
| 5,730,201 | A | 3/1998 | Rollin et al. | |
| 5,735,975 | A | 4/1998 | Lin et al. | |
| 5,896,642 | A | 4/1999 | Peker et al. | |
| 5,976,247 | A | 11/1999 | Hansen et al. | |
| 6,021,840 | A | 2/2000 | Colvin | |
| 6,189,600 | B1 | 2/2001 | Taniguchi et al. | |
| 6,267,170 | B1 | 7/2001 | Onuki et al. | |
| 6,267,171 | B1 | 7/2001 | Onuki et al. | |
| 6,283,197 | B1 | 9/2001 | Kono | |
| 6,325,868 | B1 | 12/2001 | Kim et al. | |
| 6,371,195 | B1 | 4/2002 | Onuki et al. | |
| 6,427,753 | B1 | 8/2002 | Inoue et al. | |
| 6,499,529 | B1 | 12/2002 | Farkas | |
| 6,502,624 | B1 | 1/2003 | Williams et al. | |
| 6,742,567 | B2 | 6/2004 | Winterbottom et al. | |
| 6,769,474 | B2 | 8/2004 | Engels et al. | |
| 6,875,293 | B2 | 4/2005 | Peker | |
| 7,017,645 | B2 | 3/2006 | Johnson et al. | |
| 7,235,910 | B2 | 6/2007 | Decristofaro et al. | |
| 7,377,303 | B2 | 5/2008 | Go | |
| 7,488,170 | B2 | 2/2009 | Yuasa et al. | |
| 7,575,040 | B2 | 8/2009 | Johnson | |
| 7,708,844 | B2 | 5/2010 | Muramatsu et al. | |
| 7,906,219 | B2 | 3/2011 | Ohara et al. | |
| 2002/0005233 | A1 | 1/2002 | Schirra et al. | |
| 2005/0028961 | A1 | 2/2005 | Toyoshima et al. | |
| 2005/0242454 | A1 | 11/2005 | Yuasa et al. | |
| 2006/0254747 | A1 | 11/2006 | Ishida et al. | |
| 2007/0079907 | A1 | 4/2007 | Johnson et al. | |
| 2007/0125509 | A1 * | 6/2007 | Hohenstein et al. | 164/119 |
| 2008/0118387 | A1 | 5/2008 | Demetriou et al. | |
| 2008/0135136 | A1 | 6/2008 | Demetriou et al. | |
| 2008/0305387 | A1 | 12/2008 | Murray et al. | |
| 2009/0162629 | A1 | 6/2009 | Demetriou et al. | |
| 2009/0236494 | A1 | 9/2009 | Hata et al. | |
| 2009/0321037 | A1 | 12/2009 | Lewis et al. | |
| 2010/0084052 | A1 | 4/2010 | Farmer et al. | |
| 2010/0098967 | A1 | 4/2010 | Schroers et al. | |
| 2010/0230012 | A1 | 9/2010 | Demetriou et al. | |
| 2010/0300148 | A1 | 12/2010 | Demetriou et al. | |
| 2011/0011750 | A1 | 1/2011 | Lovens et al. | |
| 2011/0079940 | A1 | 4/2011 | Schroers et al. | |
| 2011/0108231 | A1 | 5/2011 | Zheng et al. | |

FOREIGN PATENT DOCUMENTS

| | | |
|---|---|---|
| EP | 0718059 | 6/1996 |
| EP | 0845316 | 6/1998 |
| EP | 0912277 | 5/1999 |
| EP | 1013363 | 6/2000 |
| EP | 1415740 | 5/2004 |
| FR | 2665654 | 2/1992 |
| GB | 392764 | 5/1933 |
| GB | 574914 | 1/1946 |
| GB | 784363 | 10/1957 |
| JP | 55036033 | 3/1980 |
| JP | 60099473 | 6/1985 |
| JP | 6212205 | 8/1994 |
| JP | 8013111 | 1/1996 |
| JP | 9272929 | 10/1997 |
| JP | 2000024767 | 1/2000 |
| JP | 2000326065 | 11/2000 |
| JP | 2001071113 | 3/2001 |
| JP | 2001259821 | 9/2001 |
| JP | 2001303218 | 10/2001 |
| JP | 2004050269 | 2/2004 |
| JP | 2006289466 | 10/2006 |
| JP | 2008104610 | 5/2008 |
| JP | 2009068101 | 4/2009 |
| JP | 2009172627 | 8/2009 |
| JP | 2009173964 | 8/2009 |
| JP | 2010036210 | 2/2010 |
| KR | 20040056728 | 7/2004 |
| WO | WO0037201 | 6/2000 |
| WO | WO0037693 | 6/2000 |
| WO | WO0240727 | 5/2002 |
| WO | WO2005004559 | 1/2005 |
| WO | WO2006127792 | 11/2006 |
| WO | WO2008046219 | 4/2008 |
| WO | WO2009067512 | 5/2009 |
| WO | WO2010108744 | 9/2010 |
| WO | WO2010111701 | 9/2010 |

OTHER PUBLICATIONS

Shen et al., 01., "Bulk Glassy CO43FE20TA5.5B31.5 Alloy with High Glass-Forming Ability and Good Soft Magnetic Properties", Materials Transactions, vol. 42 No. 10 (2001) pp. 2136-2139.

McDeavitt et al., "High Temperature Interaction Behavior at Liquid Metal-Ceramic Interfaces", Journal of Materials Engineering and Performance, vol. 11, Aug. 2002.

Kargahi et al., "Analysis of failure of conducting crucible used in induction metal", Aug. 1988.

Inoue et al., "Microstructure and Properties of Bulky Al84Ni10Ce6 Alloys with Amorphous Surface Layer Prepared by High-Pressure Die Casting", Materials Transactions, JIM, vol. 35, No. 11 (1994), pp. 808-813.

International Search Report issued in PCT/US2011/052354, mailed Mar. 16, 2012.

International Search Report issued in PCT/US2011/054153, mailed Jun. 13, 2012.

International Search Report issued in PCT/US2012/033800, mailed Dec. 18, 2012.

Wolf, S.; R.N. Tauber (1986),Silicon Processing for the VLSI Era: vol. 1—Process Technology. Lattice Press. pp. 531-534, 546.

Kohler, Michael (1999). Etching in Microsystem Technology. John Wiley & Son Ltd. p. 329.

Walker, Perrin; William H. Tarn (1991), CRC Handbook of Metal Etchants. pp. 287-291.

JPO machine translation of JP 2000-326065 A, Nov. 28, 2000.

* cited by examiner

PRIOR ART

PRIOR ART

COUNTER-GRAVITY CASTING OF HOLLOW SHAPES

CROSS-REFERENCE TO RELATED APPLICATIONS

The present application is a divisional of U.S. patent application Ser. No. 13/628,593, filed Sep. 27, 2012, which Applicant claims the benefit of priority and is being incorporated by reference herein in its entirety.

FIELD OF THE INVENTION

The present embodiments relate to methods and apparatus for forming various hollow parts of bulk-solidifying amorphous alloy by counter-gravity casting.

BACKGROUND

A large portion of the metallic alloys in use today are processed by solidification casting, at least initially. The metallic alloy is melted and cast into a metal or ceramic mold, where it solidifies. The mold is stripped away, and the cast metallic piece is ready for use or further processing. The as-cast structure of most materials produced during solidification and cooling depends upon the cooling rate. There is no general rule for the nature of the variation, but for the most part the structure changes only gradually with changes in cooling rate. On the other hand, for the bulk-solidifying amorphous alloys the change between the amorphous state produced by relatively rapid cooling and the crystalline state produced by relatively slower cooling is one of kind rather than degree—the two states have distinct properties.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. This amorphous state can be highly advantageous for certain applications. If the cooling rate is not sufficiently high, crystals may form inside the alloy during cooling, so that the benefits of the amorphous state are partially or completely lost. For example, one risk with the creation of bulk amorphous alloy parts is partial crystallization due to either slow cooling or impurities in the raw material.

Bulk-solidifying amorphous alloys have been made in a variety of metallic systems. They are generally prepared by quenching from above the melting temperature to the ambient temperature. Generally, high cooling rates, such as one on the order of $10^{5\circ}$ C./sec, are needed to achieve an amorphous structure. The lowest rate by which a bulk solidifying alloy can be cooled to avoid crystallization, thereby achieving and maintaining the amorphous structure during cooling, is referred to as the "critical cooling rate" for the alloy. In order to achieve a cooling rate higher than the critical cooling rate, heat has to be extracted from the sample.

Until the early nineties, the processability of amorphous alloys was quite limited, and amorphous alloys were readily available only in powder form or in very thin foils or strips with a critical thickness of less than 100 micrometers. A class of amorphous alloys based mostly on Zr and Ti alloy systems was developed in the nineties, and since then more amorphous alloy systems based on different elements have been developed. These families of alloys have much lower critical cooling rates of less than $10^{3\circ}$ C./sec, and thus they have much larger critical casting thicknesses than their previous counterparts. However, little has been shown regarding how to utilize these alloy systems into structural components.

Thus, there is a need to provide methods and apparatus for forming structural components as desired.

SUMMARY

The embodiments described herein relate to methods and apparatus for forming hollow parts from a molten metal alloy by counter-gravity casting. The formed hollow parts may include a shell surrounding a hollow cavity. The shell may be a bulk metallic glass (BMG)-containing shell. The hollow parts may have various hollow shapes, enclosures, tubes, preforms, and other similar items.

In accordance with various embodiments, there is provided a method of forming a hollow part. In such a method, a molten metal alloy may be fed in a counter-gravity direction into a mold cavity to deposit the molten metal alloy on a surface of the mold cavity. As the deposited metal alloy solidifies on the surface of the mold cavity, a BMG-containing shell may be formed surrounding a hollow cavity.

In accordance with various embodiments, there is provided a method of forming a hollow part. A mold may be provided including a mold cavity having a predetermined shape and dimension according to the hollow part. A molten metal alloy may then be fed in a counter-gravity direction into the mold cavity, at least in a charge amount according to an amount of the hollow part to deposit the molten metal alloy onto a surface of the mold cavity. Optionally, a fluid stream may be applied into the molten metal alloy within the mold cavity to form a hollow cavity in the molten metal alloy. As the deposited metal alloy solidifies against the surface of the mold cavity, a BMG-containing shell may be formed surrounding the hollow cavity.

In accordance with various embodiments, there is provided a method of forming a hollow part by first feeding a molten metal alloy in a counter-gravity direction through a feed pipe into a mold cavity to deposit the molten metal alloy onto a surface of the mold cavity. While feeding, the feed pipe may be adjusted with one end of the feed pipe in the molten metal alloy and the other end within the mold cavity to adjust a passage of the molten metal alloy into the mold cavity and to direct the deposition of the molten metal alloy. Optionally, a fluid stream may be applied into the molten metal alloy within the mold cavity to form a hollow cavity in the molten metal alloy. As the deposited metal alloy solidifies against the interior surface of the mold cavity, a BMG-containing shell may be formed surrounding the hollow cavity.

The method could further comprise applying a fluid stream into the molten metal alloy to form a hollow cavity in the molten metal alloy within the mold cavity. The method could further comprise applying a fluid stream after the molten metal alloy deposited on the surface of the mold cavity has a thickness exceeding a critical casting thickness of the molten metal alloy. The method could further comprise controlling one or more parameters selected from a charge amount, a viscosity, a temperature, an injection rate, and an injection pressure applied to the molten metal alloy and combinations thereof to control a shell thickness of the BMG-containing hollow part. The method could further comprise moving or spinning a mold comprising the mold cavity to control feeding and deposition of the molten metal alloy, in the counter-gravity direction, into the mold cavity. The method could further comprise configuring a fountainhead with a plurality of holes distributed therein for depositing the molten metal alloys onto the surface of the mold cavity.

Optionally, feeding a molten metal alloy into a mold cavity comprises applying an injection pressure on the molten metal alloy through one or more passages into the mold cavity. Optionally, applying the injection pressure comprises using a pressurized gas or a mechanical means. Optionally, applying the fluid stream comprises applying one or more inert gases into the molten metal alloy. Optionally, the fluid stream is applied at least after the molten metal alloy is deposited on the surface of the mold cavity in a charge amount according to an amount of the BMG-containing hollow part. Optionally, applying the fluid stream comprises displacing the molten metal alloy by the fluid stream, and controlling an overflow in the mold cavity to remove excess molten metal alloy from the mold cavity. Optionally, the molten metal alloy comprises an inductively melted metal alloy. Optionally, the BMG-containing hollow part is formed by generating a hollow cavity in a center of a BMG-containing shell.

In accordance with various embodiments, there is provided a device. The device may include a feed reservoir and a mold disposed above the feed reservoir and having a mold cavity. One or more feed pipes may be adjusted having one end in the feed reservoir and the other end within the mold cavity to adjust an injection or to direct a passage of a fluid from the feed reservoir into the mold cavity.

In accordance with various embodiments, there is provided a device including a feed reservoir and a mold disposed above the feed reservoir, having a mold cavity with a predetermined shape and dimension. The device further includes one or more feed pipes each adjustable in a up-down direction having one end in the feed reservoir and the other end including a distribution device such as a fountainhead within the mold cavity to adjust a passage or direct an injection of a fluid from the feed reservoir into the mold cavity. The exemplary fountainhead may have a shape or dimension corresponding to a shape or dimension of the mold cavity.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
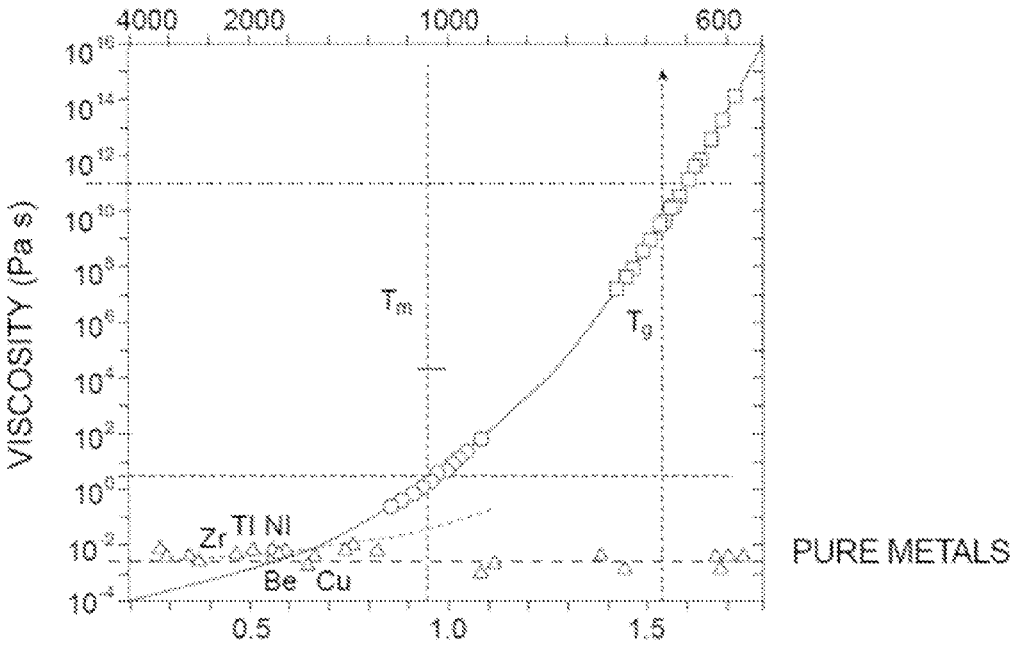
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
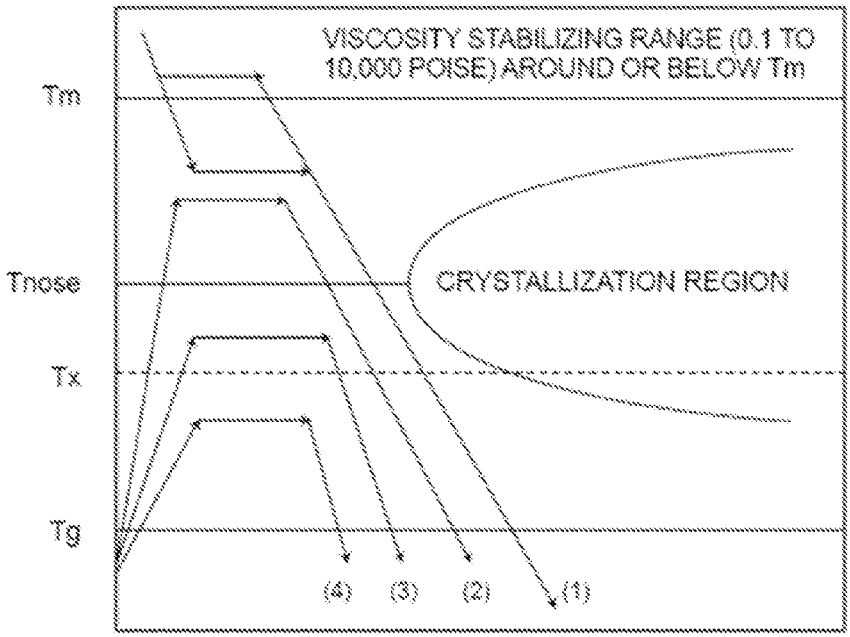
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys.

In this temperature region the bulk solidifying alloy can exist as a high viscous liquid. The viscosity of the bulk solidifying alloy in the supercooled liquid region can vary between 1012 Pa s at the glass transition temperature down to 105 Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG-containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function:

$$G(x,x')=\langle s(x),s(x')\rangle.$$

In the above function, s is the spin quantum number and x is the distance function within the particular system. This function is equal to unity when x=x' and decreases as the distance |x−x'| increases. Typically, it decays exponentially to zero at large distances, and the system is considered to be disordered. If, however, the correlation function decays to a constant value at large |x−x'|, then the system can be said to possess long-range order. If it decays to zero as a power of the distance, then it can be called quasi-long-range order. Note that what constitutes a large value of |x−x'| is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula (Zr, Ti)a(Ni, Cu, Fe)b(Be, Al, Si, B)c, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula (Zr, Ti)a(Ni, Cu)b(Be)c, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula (Zr, Ti)a(Ni, Cu)b(Be)c, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula (Zr)a(Nb, Ti)b(Ni, Cu)c(Al)d, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the afore-described alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |

TABLE 2-continued

Additional Exemplary amorphous alloy compositions (atomic %)

| Alloy | Atm % | Atm % | Atm % | Atm % | Atm % | Atm % |
|---|---|---|---|---|---|---|
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)-C—B, Co—Cr—Mo-Ln-C—B, Fe—Mn—Cr—Mo—(Y,Ln)-C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include Pd44.48Cu32.35Cu4.05P19.11, Pd77.5Ag6Si9P7.5, and Pt74.7Cu1.5Ag0.3P18B4Si1.5.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature Tx. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Embodiments herein relate to means of producing hollow shapes, enclosures, tubes, preforms, and other similar items using a countergravity casting apparatus with molten alloys, including bulk metallic glass-forming alloys. This process involves selecting an appropriate shot size, alloy melt temperature, and injection parameters to deposit and rapidly solidify molten alloy on the interior surfaces of the mold cavity, then remove excess alloy from the center of the cavity through gas displacement, leaving a hollow shape.

Bulk-solidifying amorphous alloys have been made in a variety of metallic systems. They are generally prepared by quenching from above the melting temperature to the ambient temperature. Generally, high cooling rates, such as one on the order of $10^{5}$° C./sec, are needed to achieve an amorphous structure. The lowest rate by which a bulk solidifying alloy can be cooled to avoid crystallization, thereby achieving and maintaining the amorphous structure during cooling, is referred to as the "critical cooling rate" for the alloy. In order to achieve a cooling rate higher than the critical cooling rate, heat has to be extracted from the sample. Thus, the thickness of articles made from amorphous alloys often becomes a limiting dimension, which is generally referred to as the "critical casting thickness." A critical thickness of an amorphous alloy can be obtained by heat-flow calculations, taking into account the critical cooling rate. According to one embodiment, proper mold temperature regulation would allow the hollow part to have wall thickness of critical casting thickness.

In another variation, one could have a straw/tube tip that is located close to the top of the mold and then draw it down as the mold is filled.

In another variation, one could simultaneously perform slip casting while filling the mold by the counter gravity casting method.

The embodiments described herein relate to methods and apparatus for forming hollow parts from a molten metal alloy by counter-gravity casting. The formed hollow parts may include a shell surrounding a hollow cavity. The shell may be a bulk metallic glass (BMG)—containing shell. The hollow parts may have various hollow shapes, enclosures, tubes, preforms, and other similar items.

In accordance with various embodiments, there is provided a method of forming a BMG-containing hollow part. In such a method, a molten metal alloy may be fed, for example, injected, pumped, or urged, etc., in a counter-gravity direction into a mold cavity to deposit the molten metal alloy on a surface of the mold cavity. Optionally, a fluid stream may be applied, e.g., in a counter-gravity direction, into the molten metal alloy within the mold cavity to form a hollow cavity in the molten metal alloy. As the deposited metal alloy solidifies against the surface of the mold cavity, a BMG-containing shell may be formed surrounding the hollow cavity to form BMG-containing hollow parts.

As used herein, the term "a counter-gravity direction" is a direction that can be upward, sideward or in any direction but not in a direction that could allow unassisted natural flow under gravity.

For example, a counter-cavity casting apparatus may include a feed reservoir, a mold including a mold cavity placed over the feed reservoir, one or more feed pipes configured to communicate between the feed reservoir and the mold cavity to provide a passage there-between.

The feed reservoir may be used to contain a fluid such as a molten metal alloy. The feed reservoir may be maintained at certain temperatures to maintain a fluidic state of the molten metal alloy or other fluid in the feed reservoir.

The molten metal alloy may be any metal alloy as described above. The molten metal alloy may be an inductively melted metal alloy. In one example, the molten metal alloy may be formed by melting metals, alloys, and/or BMG feedstock in a vessel such as a melt crucible. The melting may be performed in a non-reactive environment, e.g., in a vacuum environment or in an inert environment. to prevent any reaction, contamination or other conditions which might detrimentally affect the quality of the resulting articles. In embodiments, single charges or multiple charges of materials to be melted at once may be melt in the melt vessel. In some cases, an induction vessel may be used in a vacuum to inductively melt metals and/or alloys, e.g., using induction skull remelting or melting, vacuum induction melting (VIM), electron beam melting, resistance melting, plasma arc, etc. For example, an inductive heating coil may be used as a heat source surrounding at least a portion of the melt vessel. The inductive heating coil may be coupled to a power source to generate a field that passes through the melt vessel, and heats and melts the materials located within the melt vessel. In some cases, the field also serves, e.g., to agitate or stir the molten metal alloys. In embodiments, the melt vessel may be used as the feed reservoir configured to maintain the temperature of the molten material. Alternatively, the molten material may be transferred from the melt vessel into the feed reservoir and maintained molten in the feed reservoir.

The molten metal alloy may have desired rates of heat transfer and consequently desired metal solidification rate. The solidified metal alloy forms a BMG-containing shell surrounding a hollow cavity. As described herein, the hollow part may be referred to as a BMG-containing hollow part or a BMG hollow part.

In one embodiment, an injection pressure may be applied on the molten metal alloy to urge the molten metal alloy, through one or more passages or feed pipes, into the mold cavity to deposit and solidify the molten metal alloy against/on the interior wall of the mold cavity. The injection pressure may be applied using a pressurized gas or any possible mechanical means.

The mold cavity may have a predetermined shape and/or dimension, depending on the shape and/or dimension of a final product of the hollow part as desired. For example, the mold cavity may have a spherical, cylindrical, prism, or other shape. Accordingly, the resultant hollow part formed against the wall of the mold cavity may have a supplementary outer shape as compared with the inner shape of the surface of the mold cavity. The hollow part may be a tube, a cup, a flask, conical flask, a vase, etc.

The interior wall of the mold cavity may have a lower temperature than the molten metal alloy to solidify the molten metal alloy against the wall. The molten metal alloy, for example, molten BMG alloy, after injected into the mold cavity, may be solidified on the surface of interior wall of the mold cavity. The surface temperature of the mold cavity may be regulated such that a cooling rate of the molten metal alloy may be controlled as desired to form a bulk-solidifying amorphous alloy, i.e., BMG on the surface of the mold cavity. In embodiments, the surface temperature of the mold cavity may be controlled by, e.g., using temperature regulating channels having cooling fluid such as water or air flow therein. In one embodiment, the temperature regulating channels may be configured in the wall of the mold cavity. Other cooling methods or systems as known in the art may also be used. In this manner, the BMG alloy may be deposited and solidified until a thickness excesses the critical casting thickness of the alloys used.

In embodiments, the mold having the mold cavity may be movable in any direction and/or rotatable in a direction perpendicular to the feed pipes or the gravity direction. When rotation is applied to the mold during injection of the molten metal alloy, a more uniform application or deposition of the molten metal alloy can be obtained on the interior surface of the mold cavity. In addition, the movable and/or rotatable mold may permit disconnection of the feed pipe from the mold so that the feed pipe may be connected to another or a second mold to feed molten metal there-into, while the molten metal in the first mold from which the pipe has been disconnected, solidifies. In this manner, the rate of production may be accelerated as compared to other methods of counter-gravity casting in which the feed pipe remains connected to the mold until such time as the molten metal has solidified sufficiently for disconnection. Alternatively, the molds may be produced continuously and then moved to the molten metal alloy source for feeding or filling and then moved away for cooling.

The feed pipes, e.g., straws, may provide a passage between the mold cavity and the feed reservoir. The feed pipes may or may not be inserted within the mold cavity. For example, one or more of the feed pipes may have one end inserted within the mold cavity and the other end inserted in the molten metal alloy. In embodiments, the feed pipes may be movable and adjustable in a controllable manner. For example, by moving feed pipes in a up-down direction (e.g., along a counter-gravity direction) to change or adjust a length within the mold cavity, the passage of the molten metal alloy into the mold cavity can be controlled or adjusted and the injection of the molten metal alloy onto the interior surface of the wall of the mold cavity may be controlled or directed.

In embodiments, regardless of whether the feed pipes are inserted within the mold cavity, a distribution device such as a fountainhead or the like may be configured at one end of the feed pipe located within the mold cavity. The fountainhead may include holes distributed there-in, uniformly or non-uniformly, for applying the molten metal alloys from the feed pipe to squirt onto the interior surface of the mold cavity. The fountainhead may have an outer shape or dimension corresponding to a shape or dimension of the mold cavity. The fountainhead may be rotated in a controllable manner, e.g., rotating in 360 degree for uniformly depositing the molten metal alloy.

During the disclosed counter-gravity casting, various parameters can be controlled, selected, or determined to form desired hollow part. For example, this process involves: selecting an appropriate shot/injection size, e.g., charge amount, of the molten metal alloy to feed the mold cavity, alloy melt temperature, viscosity of the molten metal alloy, injection parameters (e.g., the injection pressure applied to the molten metal alloy, injection rate, etc.) to deposit and solidify molten alloy, flow rate and/or pressure applied to the fluid stream to control, for example, thickness of the amorphous shell and shape of the hollow cavity of the final hollow part. The charge amount of the molten metal alloy may be at least an amount (e.g., weight) required to form the desired final hollow part, which may be calculated. In embodiments, a vacuum may or may not be used to facilitate the formation process.

To form a hollow cavity in the molten metal alloy deposited on the mold cavity, a fluid stream may be applied into the molten metal alloy within the mold cavity. The fluid stream may include a pressurized flow of one or more inert gases. The fluid stream may have a temperature at least the temperature of the molten metal alloy such that the molten metal alloy remains molten for the gases to flow into and thus to form a hollow cavity there-in. The fluid stream may be applied into the material deposited on the mold cavity after the deposited material has a thickness exceeding a critical casting thickness of the molten metal alloy. The molten metal alloy first hit the surface of the interior wall may be solidified until the solidification reaching a desired thickness and leaving behind a shell, e.g., amorphous shell, against the interior surface of the mold cavity. In embodiments, the formation of the shell may be controlled to have a uniform thickness. In embodiments, formation of the hollow cavity may be controlled to be in the center of the amorphous shell.

The fluid stream may be applied while the molten metal alloy sufficiently fills the mold cavity with desired charge amount. For example, excess molten metal alloy may be removed from, e.g., center of, the mold cavity by displacement of the fluid stream, leaving the hollow cavity within the molten metal alloy. In this case, an overflow in the mold cavity or near a gate of the mold cavity connecting the feed pipes may be controlled such that the displaced molten metal alloy flows out of the mold cavity.

In embodiments, the fluid stream may be applied or switched thereto, when the molten metal alloy has been injected with a charge amount slightly above or exactly the same as the weight amount for forming the desired hollow part. The fluid stream may be pressurized to be at least at the injection pressure or higher.

Figure 3:
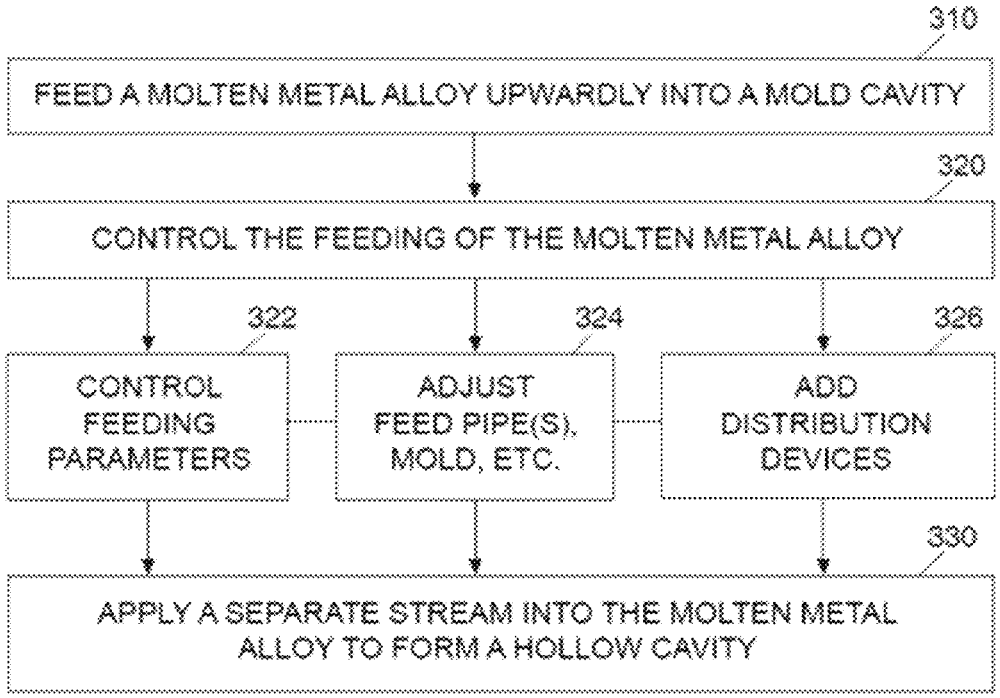
FIG. 3 illustrates exemplary methods for forming a hollow part in accordance with various embodiments of the present teachings.

FIG. 3 depicts exemplary methods for forming a hollow part, while FIGS. 4-7 depict various counter-gravity casting apparatus in accordance with various embodiments of the present teachings. Although the methods in FIG. 3 will be described herein with respect to the exemplary counter-gravity casting apparatus depicted in FIGS. 4-7, one of ordinary skill in the art will appreciate that the methods and the apparatus are not limiting in any manners.

At block 310 of FIG. 3, a molten metal alloy may be fed in a counter-gravity direction into a mold cavity using the apparatus as depicted in FIGS. 4-7.

Figure 4:
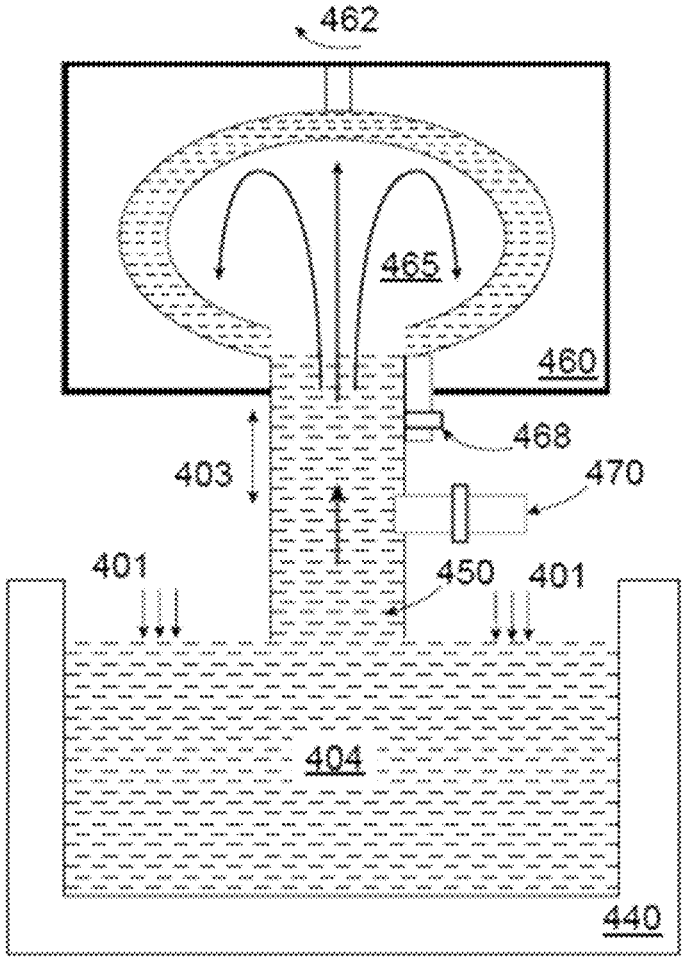
FIGS. 4 through 7 illustrate exemplary apparatus used for forming a hollow part in accordance with various embodiments of the present teachings.
Figure 5:
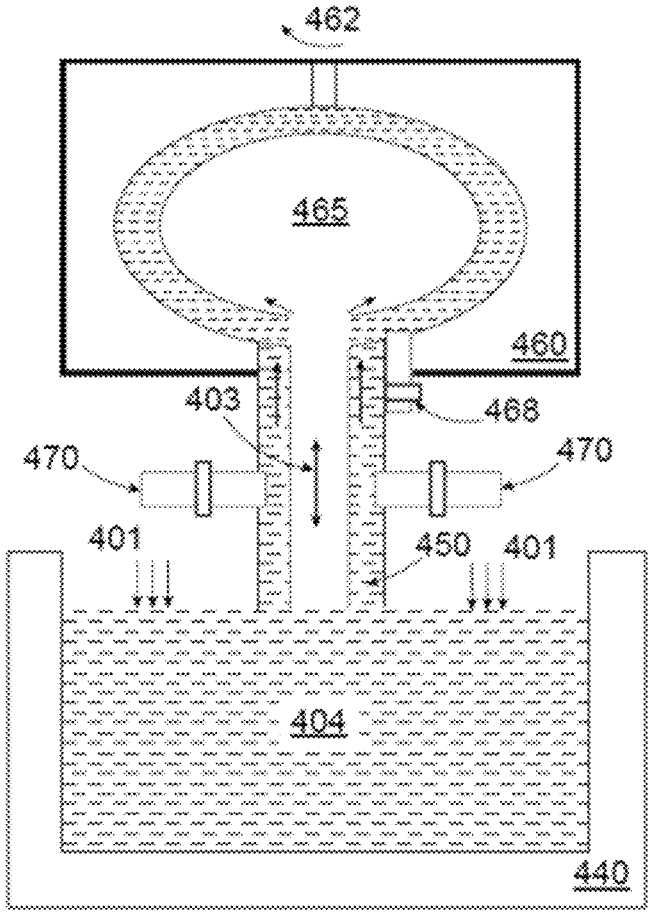
Figure 6:
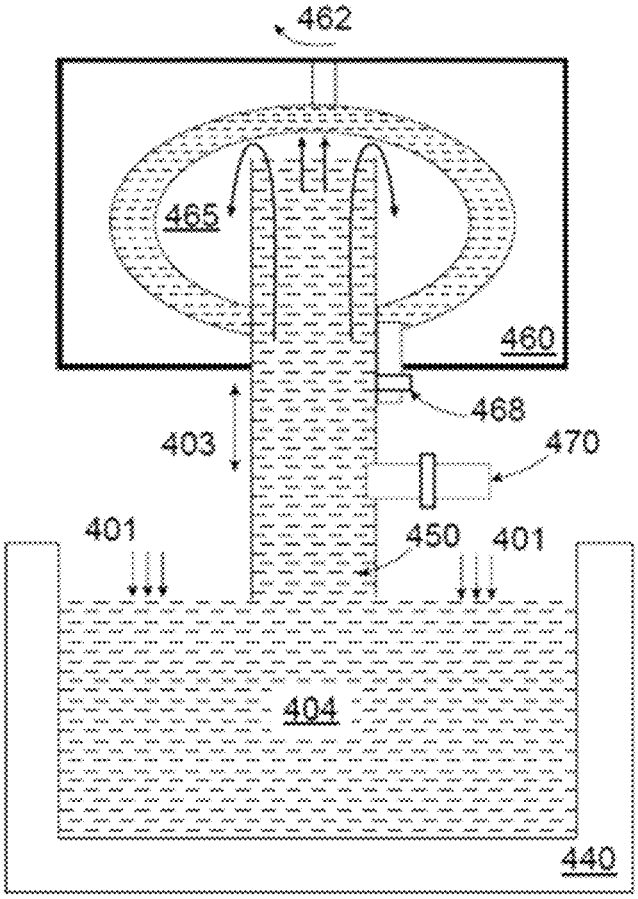

For example, FIG. 4 shows an apparatus including a feed reservoir 440, which may contain a fluid such as molten metal alloy 404. The feed reservoir 440 may be heated, e.g., using any suitable heating means as known in the art, to maintain a temperature such that the molten metal alloy stay molten and fluidic. A mold 460 having a mold cavity 465 may be disposed above the feed reservoir 440 and connected with one another by a feed pipe 450 or a plurality of feed pipes 450 as shown in FIG. 5. The mold 460 may be controllably rotated or span, e.g., in a direction of 462, to control, adjust, or direct the injection or deposition or solidification of the molten metal alloy within the mold cavity.

The molten metal alloy 404 may be fed in a counter-gravity direction into the mold cavity 465 by applying an injection pressure 401 on the molten metal alloy 404 through one or more passages provided by the feed pipes 450. The injection pressure may be applied by a pressurized gas, a mechanical means, or any manner to urge the molten metal alloy 404 into the mold cavity 465. The injection pressure 401 applied to the molten metal alloy 404 may be balanced against the downward gravity pressure so that the mold cavity 465 may be filled in a non-turbulent manner.

The molten metal alloy 404 may be deposited onto a surface of the mold cavity 465. The molten metal alloy 404 may be controlled at block 320 of FIG. 3, for example, by controlling feeding parameters at block 322 of FIG. 3, by adjusting the number of feed pipes used and adjusting length/height within the mold cavity and/or the molten metal alloy 404 in the feed reservoir 440 at block 324 of FIG. 3, and/or by configuring additional functional device such as configuring a fountainhead or the like at block 326 of FIG. 3 to adjust and/or direct the injection and/or deposition of the molten metal alloy 404.

At block 330, a fluid stream may be applied into the molten metal alloy 404 within the mold cavity 465 to form a hollow cavity in the molten metal alloy, while the deposited metal alloy solidifies against the interior surface of the mold cavity 465 to form an amorphous shell surrounding the hollow cavity. The fluid stream may include one or more inert gases and/or may be pressurized. For example, as shown in FIG. 4, a device 470 for applying the fluid stream may be incorporated into the feed pipe 450. Alternatively, the device 470 may be incorporated into the feed reservoir 440 for applying the fluid stream into the molten metal alloy within the mold cavity. The device 470 for applying the fluid stream may be capable of applying pressurized gases or may include a valve to control the stream application. In embodiments, the fluid stream may or may not share a portion or use the passages for feeding the molten metal alloy into the mold cavity.

Referring back to FIG. 3, during the process, at block 322, one or more parameters, such as, for example, the charge amount, viscosity, temperature, injection rate, and/or injection pressure applied to the molten metal alloy 404 may be controlled to adjust and/or direct deposition of the molten metal alloy on the interior surface of the mold cavity 465. Once deposited, the molten metal alloy 404 may start solidify against the interior surface of the mold cavity 465.

For example, the material required for forming the hollow parts may be calculated according to the weight of the hollow parts as desired. The charge amount of the molten metal alloy 404 may then be determined to be at least the amount of the desired hollow part for deposition on the interior surface of the mold cavity. The fluid stream may be applied at least after the molten metal alloy is deposited in a charge amount according to a weight of the desired amorphous shell.

In one embodiment, excess amount of molten metal alloy may be fed into the mold cavity, and be displaced by the fluid stream to form a hollow cavity into the deposited molten metal alloy, while an overflow may be controlled to remove excess molten metal alloy from the mold cavity, for example, by a device 468 for removing fluid from the mold cavity 465.

In another embodiment, the injection of the molten metal alloy into the mold cavity may be discontinued when a substantially amount for forming the desired hollow part has been fed into the mold cavity. This may be followed by applying the fluid stream there-into, while maintaining the injection pressure to substantially prevent the molten metal alloy from flowing out of the mold cavity.

At block 324 of FIG. 3, the deposition of the molten metal alloy and the formation of the hollow part can be controlled by adjusting the one or more feed pipes 450. For example, adjustable feed pipes 450, see FIGS. 4-6, may be adjust in a up-down direction 403 having one end in the fluid 404 contained the feed reservoir 440 and the other end within the mold cavity 465 to adjust the passage or to direct the injection of a fluid from the feed reservoir 440 into the mold cavity 265.

Figure 7:
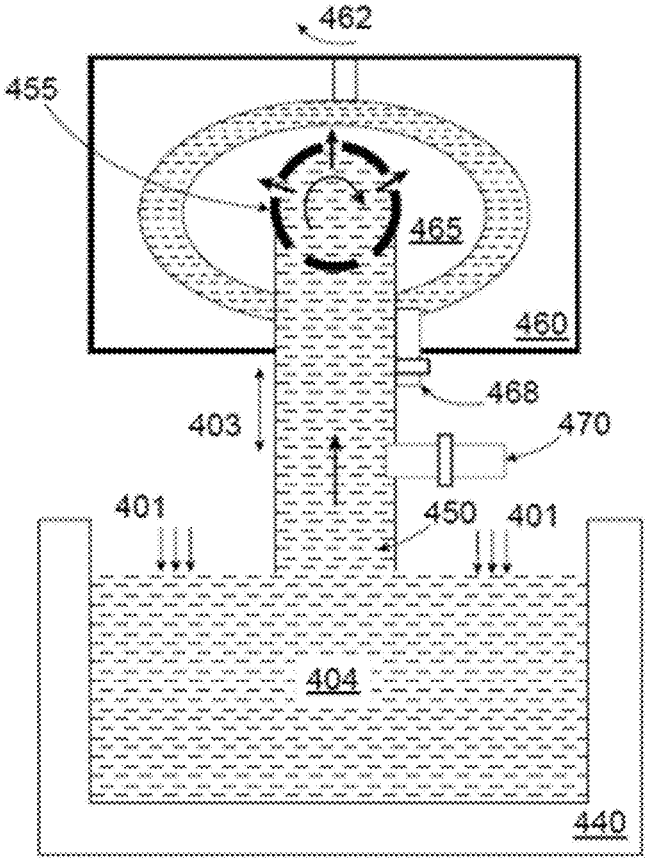

At block 326 of FIG. 3, the deposition of the molten metal alloy and the formation of the hollow part can be controlled by, as shown in FIG. 7, adjustable feed pipes 450 and/or other distribution devices such as a fountainhead 455 to adjust or direct or control distribution of the molten metal alloy for the deposition and solidification against the interior surface of the mold cavity 465. For example, the fountainhead 455 may contain a plurality of holes distributed therein for inject the molten metal alloys through the holes onto the interior surface of the mold cavity. Meanwhile, the fountainhead 455 may or may not be spinning or moving relatively to the feed pipe 450 as desired.

Figure 8:
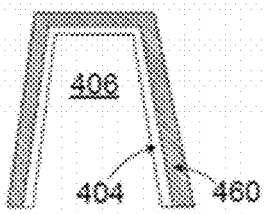
FIG. 8 illustrates an exemplary hollow part having a metal alloy shell formed against a surface of a mold cavity in accordance with various embodiments of the present teachings.

FIG. 8 depicts a schematic showing the deposited molten metal alloy 404 solidifies against a surface of a mold cavity in a mold 460. The solidified metal alloy 404 may have an outer shape determined by, i.e., supplementary to, a shape of the interior surface of the mold cavity in the mold 460. The solidified metal alloy 404 may surround a hollow cavity 406 to form a hollow part. The solidified metal alloy 404 may be processed with a desired cooling rate. The solidified metal alloy 404 may form a BMG-containing shell. The BMG-containing shell may have a uniform or non-uniform thickness throughout the entire shell. The BMG-containing shell may have a thickness greater than a critical casting thickness of the molten metal alloy. The hollow cavity 406 may be formed in a center of the shell 404. The BMG-containing hollow part depicted in FIG. 8 may be removed from the mold cavity after formation. In embodiments, a plurality of hollow cavities may be surrounded by the solidified metal alloy, e.g., the BMG-containing alloy, to form the BMG-containing hollow part.

In embodiments, the thickness of the BMG-containing shell 404 and the shape of the hollow cavity 406 (see FIG. 8) may be controlled during formation (as depicted in FIG. 3), e.g., by controlling one or more parameters including, but not limited to, the charge amount, viscosity, temperature, injection rate, and injection pressure applied to the molten metal alloy, a flow rate of the fluid stream, a pressure applied to the fluid stream, and combinations thereof.

Note that the mold 406 shown in FIG. 8 is a portion of a mold depicted for illustration purpose, while other hollow parts having various outer shapes/dimensions, regular or irregular, centered or non-centered, may be formed using the disclosed method and apparatus as depicted in FIGS. 3-7.

Figure 9A:
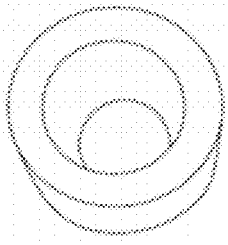
FIGS. 9A through 9D illustrate various exemplary hollow parts formed in accordance with various embodiments of the present teachings.
Figure 9B:
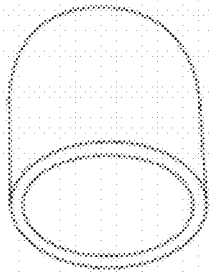

For example, FIGS. 9A-9D depict various exemplary hollow parts formed by using the disclosed methods and apparatus. The hollow parts may be formed having various hollow shapes and outer shapes. In FIGS. 9A-9B, each exemplary BMG-containing hollow part can be in a cylindrical shape with uniform shell thickness. The uniform thickness for each of the BMG-containing hollow parts in FIGS. 9A-9B can be controlled, e.g., depending on the selected metal alloys and/or the process parameters.

Figure 9C:
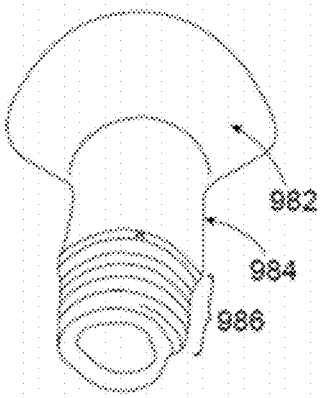
Figure 9D:
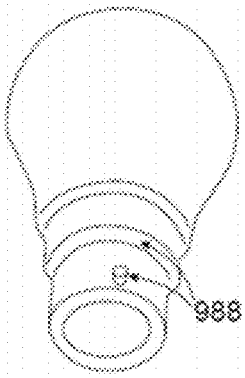

In embodiments, the shape and/or thickness of the BMG-containing shell may vary in the same hollow part, for example, as shown in FIGS. 9C-9D. In FIG. 9C, the formed BMG-containing hollow part can include portions 982, 984, 986 having different shapes. In embodiments, the BMG-containing hollow parts may further include structures, e.g., micro-structures on the outer surface thereof. Such surface structures may be formed during the molding process, e.g., using a mold cavity having the corresponding structures on the surface of the mold cavity. Alternatively, such surface structures may be formed by a post-process, e.g., thermoplastic forming, of the BMG-containing hollow parts. For example, the BMG-containing hollow parts in FIGS. 9A-9B can include surface structures 986 and 988 as desired.

In embodiments, the presently described BMG hollow parts may be used on housings or other parts of an electronic device, such as, for example, a part of the housing or casing of the device or an electrical interconnector thereof. The methods can also be used to manufacture portions of any consumer electronic device, such as cell phones, desktop computers, laptop computers, and/or portable music players. As used herein, an "electronic device" can refer to any electronic device, such as consumer electronic device. For example, it can be a telephone, such as a cell phone, and/or a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard driver tower housing or casing, laptop housing, laptop keyboard, laptop track pad, desktop keyboard, mouse, and speaker. The BMG-containing hollow parts can also be applied to a device such as a watch or a clock.

While the invention is described and illustrated here in the context of a limited number of embodiments, the invention may be embodied in many forms without departing from the spirit of the essential characteristics of the invention. The illustrated and described embodiments, including what is described in the abstract of the disclosure, are therefore to be considered in all respects as illustrative and not restrictive. The scope of the invention is indicated by the appended claims rather than by the foregoing description, and all changes that come within the meaning and range of equivalency of the claims are intended to be embraced therein.

What is claimed is:

1. An apparatus comprising:

a feed reservoir;

a mold comprising a mold cavity and configured to receive in a counter-gravity direction a fluid from the feed reservoir into the mold cavity, through one or more feed pipes, wherein the one or more feed pipes are configured to adjust a rate of flow of the fluid therethrough, wherein the one or more feed pipes comprise a fountainhead configured to direct the fluid.

2. The apparatus of claim 1, wherein the mold is capable of moving or spinning in a controllable direction.

3. The apparatus of claim 1, wherein the fountainhead and the mold are capable of moving or spinning in a controllable direction with respect to each other.

4. The apparatus of claim 1, wherein the fountainhead comprises non-uniformly distributed holes, configured to apply the fluid onto an interior surface of the mold cavity.

5. The apparatus of claim 1, wherein the feed reservoir is configured to contain a molten metal alloy.

6. The apparatus of claim 1, wherein the feed reservoir is configured to maintain a temperature of the fluid.

7. The apparatus of claim 1, wherein the feed reservoir is fluidly coupled to a melt vessel configured to melt a metal alloy contained therein.

8. The apparatus of claim 1, wherein the apparatus is configured to remove an excess fluid from the mold cavity.

9. The apparatus of claim 1, wherein the apparatus is configured to control a flow of the fluid through the one or more feed pipes.

10. An apparatus comprising:

a feed reservoir;

a mold comprising a mold cavity and configured to receive in a counter-gravity direction a fluid from the feed reservoir into the mold cavity, through one or more feed pipes, wherein the one or more feed pipes are configured to adjust a rate of flow of the fluid therethrough, wherein the apparatus is configured to apply a stream comprising a second fluid into the fluid to form a hollow cavity in the fluid within the mold cavity.

11. The apparatus of claim 10, wherein the second fluid comprises an inert gas.

12. An apparatus comprising:

a feed reservoir;

a first mold removably and fluidly coupled to the feed reservoir, the mold comprising a mold cavity and configured to receive in a counter-gravity direction a fluid from the feed reservoir into the mold cavity, through one or more feed pipes, wherein the one or more feed pipes are configured to adjust a rate of flow of the fluid therethrough, wherein the one or more feed pipes comprise a fountainhead configured to direct the fluid.

13. The apparatus of claim 12, further comprising a second mold configured to removably and fluidly couple with the feed reservoir upon removal of the first mold.

14. The apparatus of claim 13, wherein the first mold and the second mold each are capable of spinning in a controlled direction.

15. An apparatus comprising:

a feed reservoir configured to contain a molten amorphous metal alloy;

a mold comprising a mold cavity and configured to receive in a counter-gravity direction the molten amorphous metal alloy from the feed reservoir in the mold cavity, through one or more feed pipes;

wherein the one or more feed pipes are configured to adjust a rate of flow of the molten amorphous metal alloy therethrough, wherein the apparatus is configured to form a hollow part of the amorphous metal alloy on an interior surface of the mold cavity, and wherein thickness of a wall of the hollow part does not exceed a critical casting thickness of the amorphous metal alloy, wherein the one or more feed pipes comprise a fountainhead configured to direct the fluid.

16. The apparatus of claim 15, wherein the feed reservoir is fluidly coupled to a melt vessel configured to melt the amorphous metal alloy contained therein.

17. The apparatus of claim 15, wherein the mold further comprises a temperature regulating channel configured to regulate a temperature of an interior wall of the mold cavity such that molten amorphous metal alloy injected into the mold cavity is solidified on the interior wall of the mold cavity.

18. The apparatus of claim 15, wherein the one or more feed pipes are controllably adjustable.

* * * * *